US007909943B2

(12) United States Patent
Baudis et al.

(10) Patent No.: US 7,909,943 B2
(45) Date of Patent: Mar. 22, 2011

(54) METHOD FOR HARDENING STAINLESS STEEL AND MOLTEN SALT BATH FOR REALIZING SAID PROCESS

(75) Inventors: Ulrich Baudis, Alzenau (DE); Michael Niedermeyer, Neulussheim (DE)

(73) Assignee: Durferrit GmbH, Mannheim (DE)

( * ) Notice: Subject to any disclaimer, the term of this patent is extended or adjusted under 35 U.S.C. 154(b) by 844 days.

(21) Appl. No.: 11/808,557

(22) Filed: Jun. 11, 2007

(65) Prior Publication Data

US 2008/0099108 A1 May 1, 2008

(30) Foreign Application Priority Data

Jun. 9, 2006 (DE) ..... 10 2006 026 883

(51) Int. Cl.
*C23C 8/40* (2006.01)
*C23C 22/70* (2006.01)

(52) U.S. Cl. ..... 148/227; 148/28; 148/242

(58) Field of Classification Search ..... 148/242, 148/225, 227, 28

See application file for complete search history.

(56) References Cited

U.S. PATENT DOCUMENTS 2,248,732 A * 7/1941 Albrecht et al. ..... 148/631
5,593,510 A 1/1997 Tahara et al.

FOREIGN PATENT DOCUMENTS

DE 1 007 795 5/1957
EP 0 054 962 A1 12/1981
GB 2 153 855 A 8/1985

OTHER PUBLICATIONS

Kolsterisieren® (Kolsterising®—Corrosion resistant surface hardening of austenitic stainless steel) [online], [retrieved on Apr. 16, 2010] Retrieved from the Bodycote website using Internet <URL: http://internet.bodycote.org/deu/media/files/Brochures/Processes/Kolsterising/Kolsterising-B/Brochure_Kolsterisieren_DE_10_2008.pdf>.

Gümpel, P. et al., "Rostfreie Stähle" (Corrosion-Resistant Steels), Expert Publishing House, vol. 349 (1998), Renningen Malmsheim.

Günther, D., et al., "Oberflächenhärtung von Austenitischen Stählen unter Beibehaltung der Korrosionsbeständigkeit*" (Surface Hardening of Austenitic Steels while Maintaining Corrosion-Resistance), Härterei-Techn. Mitt. (Hardening Technology Information), 56 (2001), pp. 74-83.

Spies, H.-J., et al., "Struktur und Eigenschaften nichtrostender Stähle nach einer Plasmaimmersionsionenimplantation und einer Plasmanitrierung" (Structure and properties of stainless steels after plasma immersion ion implantation and plasma nitriding), Mat.—Wiss. U. Werkstofftech 30 (Material Knowledge and Material Technology 30), WILEY-VCH Verlag GmbH (1999), pp. 457-464.

"Edelstahl Rostfrei—Eigenschaften—Informationsstelle Edelstahl" (Corrosion-Resistant Stainless Steel—Characteristics—Information Source for Stainless Steel), 2003 [online], [retrieved on Apr. 16, 2010] Retrieved from the Edelstahl-Rostfrei website using Internet <URL:http://www.edelstahl-rostfrei.de/daten/MB_821.pdf>.

Sun, Y. et al., "The Response of Austenitic Stainless Steels to Low-temperature Plasma Nitriding," Heat Treatment of Metals, Issue No. 1 (1999), pp. 9-16.

Wägner, M., "Steigerung der Verschleißfestigkeit nichtrostender austenitischer Stähle" (Improving the Corrosion-Resistance of Non-Rusting Aust. Steels), STAHL (Steel), Issue No. 2 (2004), pp. 40-43.

German Patent and Trademark Office Action, dated May 2, 2007, issued in connection with related German Application No. 10 2006 026 883.0, and partial translation.

* cited by examiner

*Primary Examiner* — Roy King
*Assistant Examiner* — Jessee R. Roe
(74) *Attorney, Agent, or Firm* — Venable LLP; Robert Kinberg; Ryan M. Flandro

(57) ABSTRACT

A process for hardening a work piece of stainless steel through diffusion of the elements carbon and/or nitrogen into the work piece surfaces. The work piece is submerged into a molten salt bath and subjected to the molten salt bath for a period ranging from 15 minutes to 240 hours at temperatures below 450° C. In addition to potassium chloride and lithium chloride, the molten salt bath contains an activator substance consisting of barium chloride, strontium chloride, magnesium chloride and/or calcium chloride, and a free or complex cyanide as carbon-donating substance.

16 Claims, 3 Drawing Sheets

N: 100 ≙ 25 Mass Concentration %

C: 100 ≙ 10 Mass Concentration %

Mo: 100 ≙ 10 Mass Concentration %

METHOD FOR HARDENING STAINLESS STEEL AND MOLTEN SALT BATH FOR REALIZING SAID PROCESS

CROSS-REFERENCE TO RELATED APPLICATION

This application claims the priority of German Patent Application No: 10 2006 026 883.0, filed on Jun. 9, 2006, the subject matter of which is incorporated herein by reference.

BACKGROUND

The present invention relates to a process for hardening stainless steel, as well as a molten salt bath for realizing this process.

Owing to its excellent corrosion-resistance properties, stainless steel is used for constructing chemical apparatuses, in the field of food technology, in the petrochemical industry for offshore applications, for the ship and airplane construction, in architecture, for constructing houses and technical equipment, as well as for many other industrial applications.

Corrosion-resistant stainless steel is understood to refer to an iron material with at least 13% by weight of chromium added by alloying. In most cases, nickel, titanium and molybdenum are also added to the iron alloy, e.g. as explained in the Steel Instruction Leaflet 821 entitled "EDELSTAHL ROSTFREI-EIGENSCHAFTEN-INFORMATIONSSTELLE EDELSTAHL" [Corrosion-Resistant Stainless Steel-Characteristics-Information Source for Stainless Steel] PF 102205, 40013 Düsseldorf; www.edelstahl-rostfrei.de, and in P. Gümpel et al. "ROSTFREIE STÄHLE" [Corrosion-Resistant Steels], Expert Publishing House, Volume 349, Renningen Malmsheim 1998. Typical austenitic stainless steels are the alloys of steels 1.4301 or 1.4571 and have the following compositions in % by weight:

1.4301: 0.05 C; 0.5 Si; 1.4 Mn; 18.5 Cr; 9.5 Ni 1.4571: 0.03 C; 0.5 Si; 1.7 Mn; 17.0 Cr; 11.2 Ni; 2.2 Mo; 0.1 Ti.

If the chromium content is less than 13% by weight, the steel in general is not sufficiently corrosion-resistant to be considered stainless steel. The metallic chromium content of the steel therefore represents an important criterion for the corrosion resistance, as explained in P. Gümpel et al. "ROSTFREIE STÄHLE" [Corrosion-Resistant Steels], Expert Publishing House, Volume 349, Renningen Malmsheim 1998.

The fact that most generally used types of stainless steel such as 1.4301, 1.4441, 1.4541, or 1.4575 are rather soft steels and are therefore subject to scratching of the surface by hard particles such as dust or sand is a major disadvantage. Most stainless steels, apart from the very specialized martensitic stainless steels, cannot be hardened by using physical processes such as annealing and quenching. The low surface hardness frequently prevents the use of the stainless steel. Most types of stainless steel furthermore have a tendency to strong adhesion through friction, meaning two surfaces sliding against each other are welded together as a result of adhesion.

The surface of stainless steel can be enriched with nitrogen by subjecting it to a thermo-chemical treatment, e.g. nitriding or nitro-carbureting in gas (in an ammonia atmosphere), in plasma (with nitrogen/argon) or in the molten salt bath (molten cyanate salts), during which iron nitrides and chromium nitrides are formed. In contrast to physically deposited layers or layers formed by electroplating, the resulting layers are formed from the material itself, meaning they are not externally deposited and therefore have extreme adhesive strength.

Hard layers with a thickness ranging from 5 to 50 μm are thus formed, depending on the treatment length. The hardness of such nitrided or nitro-carbureted layers on stainless steel reaches values above 1000 units on the Vickers hardness scale because of the high hardness of the resulting iron nitrides and chromium nitrides.

The problem with depositing such nitrided or nitro-carbureted layers on stainless steel in practical operations is that the layers are hard, to be sure, but lose their corrosion-resistance because of the relatively high treatment temperature for the nitriding or nitro-carbureting treatment, which is in the range of 580° C. At this temperature, the diffused-in elements nitrogen and carbon form in the component surface region stable chromium nitrides (CrN) and/or chromium carbides ($Cr_7C_3$) together with the chromium. The free chromium, which is absolutely required for the corrosion resistance, is thus extracted from the stainless steel matrix up to a depth of approximately 50 μm below the surface and is converted to chromium nitride or chromium carbide. The component surface is hardened due to the iron nitride and chromium nitride that forms, but also becomes susceptible to corrosion. Such layers are worn down and/or eroded quickly during use as a result of corrosion.

The following methods are currently in use for avoiding this problem.

It is known that the surface hardness of stainless steel can be improved through electroplating, e.g. nickel-plating or depositing of physical layers with the PVD method (physical vapor deposition). These processes, however, require an alien material to be deposited on the steel surface, meaning the steel surface is no longer the surface in contact with the corrosive or abrasive medium. As a result, there are problems with the adhesion and the corrosion-resistance. These processes are consequently not widely used to improve the hardness and corrosion-resistance of stainless steel.

A hard and simultaneously corrosion-resistant layer can be formed with thermo-chemical deposition on stainless steel and using the so-called Kolsterisieren® (kolsterizing process). This process is mentioned, for example, in the information leaflet Kolsterisieren®—Anticorrosion Surface Hardening of Austenitic Corrosion-Resistant Steel—from the company Bodycote Hardiff bv, Parimariboweg 45, NL-7333 Apeldoorn, info@hardiff.de, as well as in M. Wägner, "STEIGERUNG DER VERSCHLEISS-FESTIGKEIT NICHTROSTENDER AUST. STÄHLE" [Improving the Corrosion-Resistance of Non-Rusting Aust. Steels], in "STAHL" [Steel], Issue No. 2 (2004) 40-43. The process conditions are not described either in patent literature or in the scientific literature accessible to the public. Components treated in this way have a hard, wear-resistant layer with a thickness of between 10 and 20 μm while the corrosion-resistance of the basic material is preserved. Components that are Kolsterisiert® (kolsterized) must not be heated above 400° C. since they otherwise loose their corrosion resistance.

Using the plasma nitriding process, for example described in H.-J. Spies et al. "MAT.-WISS. U. WERKSTOFFTECHNIK 30 [Material Knowledge and Material Technology 30] (1999) 457-464, as well as in Y. Sun, T. Bell et al. "The Response of Austenitic Stainless Steel to Low Temp. Plasma Nitriding Heat Treatment of Metals," Issue No. 1 (1999) 9-16, or the process of vacuum carburization as described, for example, in "OBERFLÄCHENHÄRTUNG VON AUSTENITISCHEN STÄHLEN UNTER BEIBEHALTUNG DER KORROSIONSBESTÄNDIGKEIT" [Surface Hardening of Austenitic Steels while Maintaining Corrosion-Resistance] by D. Günther, F. Hoffmann, M. Jung, P. Mayr in "HÄRTEREI-TECHN. MITT." [Hardening Technology Information], 56 (2001) 74-83, it is possible to generate an oversaturated solution of nitrogen and/or carbon at low temperatures in the surface of components made from stainless steel. This solution has the desired characteristics, meaning the higher hardness along with unchanged corrosion resistance.

However, both processes require high apparatus expenditure and high investment and energy costs, as well as the use of specially trained personnel, in most cases scientifically trained personnel, for operating the systems.

A process for the case-hardening of rust-resistant steel is known from German Patent Application DE 35 01 409 A1. With this process, the surface of the work piece to be hardened is initially activated by treating it with an acid and is then treated inside a heated fluidized bed containing active nitrogen and preferably also active carbon, capable of diffusing into the work piece.

A process for carburizing austenitic metal is described in German Patent Application DE 695 10 719 T2. According to this process, the metal is heated and kept in a fluorine-containing or fluoride-containing gas atmosphere prior to the carburization. The carburizing of the metal then takes place at a maximum temperature of 680° C.

SUMMARY

It is an object of the present invention to provide a cost-effective, efficient process for hardening stainless steel while simultaneously retaining as much as possible the corrosion resistance of the stainless steel.

The above and other objects are accomplished according to the invention wherein there is provided in one embodiment a molten salt bath used for hardening a surface of stainless steel, comprising, by weight, the following components::

30-60% potassium chloride (KCl), 20-40% lithium chloride (LiCl), 15-30% an activator substance selected from the group consisting of barium chloride ($BaCl_2$), strontium chloride ($SrCl_2$), magnesium chloride ($MgCl_2$), calcium chloride ($CaCl_2$) and admixtures thereof, and 0.2-25% a carbon-donating substance selected from the group consisting of a free cyanide, a complex cyanide and admixtures.

The invention additionally relates to a process for hardening a work piece of stainless steel through diffusing of the elements carbon and/or nitrogen into the work piece surfaces. According to an embodiment of the process, the work piece is submerged into and subjected to a molten salt bath as described above for a period ranging from 15 minutes to 240 hours and at temperatures below 450° C.

The present invention avoids high apparatus and energy expenditures and uses an relatively easy process that can be carried out even by less qualified personnel.

The invention furthermore considerably reduces the tendency of stainless steel to frictional adhesion, meaning cold-welding, and thus also the adhesive wear. The hardness of the stainless steel surface is increased from values of 200-300 Vickers to values of up to 1000 Vickers, thereby making it extremely scratch-resistant.

The use of the molten salt bath according to the invention makes it possible to harden stainless steel while maintaining its corrosion resistance.

The process according to the invention is based on the following principle.

Stainless steel is typically present in the form of austenitic steel, meaning the iron matrix has the structure of an austenite, a cubical face-centered lattice. Non-metal elements such as nitrogen and carbon can be present in this lattice in a solid solution. If carbon or nitrogen or both elements are successfully diffused into the surface of an austenitic stainless steel and are kept there in a solid saturated or even over-saturated solution, then two effects will occur:

(a) If carbon is diffused in below the chromium carbide forming temperature (420-440° C.) and nitrogen is diffused in below the chromium nitride forming temperature (350-370° C.), no carbides or nitrides of the chromium will form. As a result, no chromium is extracted from the alloy matrix in the region of the diffusion layer and the corrosion resistance of the stainless steel is preserved.

(b) The diffused-in elements expand the austenitic lattice and result in high compressive stress in the diffusion zone, which in turn leads to a considerable increase in the hardness. In scientific literature, this is referred to as expanded austenite or S-phase, which can have a hardness of up to 1000 on the Vickers scale. The term S-phase is explained, for example, in Y. Sun, T. Bell et al. in the "The Response of Austenitic Stainless Steel to Low Temp. Plasma Nitriding Heat Treatment of Metals," Issue No. 1 (1999) 9-16.

These processes are used for the present invention by utilizing the inventive molten salt bath as reactive medium and as heat-transfer medium.

The molten salt bath according to the invention contains components which can release carbon and/or nitrogen capable of diffusing, as well as suitable activator substances that cause the release at low temperatures of nitrogen and/or carbon capable of diffusing. It is essential in this connection that the treatment temperatures in the molten salt bath are below 450° C. and it is especially advantageous if they are lowered to values below the temperature where chromium carbide (420-440° C.) or chromium nitride (350-370° C.) forms, so as to prevent or mostly prevent the forming of nitrides and carbides in the steel matrix.

The concentration of active carbon-donating or nitrogen-donating compounds in the form of complex or free cyanides in the molten salt bath according to the invention is very high when compared to the concentration of corresponding compounds (ammonia, methane, carbon dioxide) in gaseous atmospheres or in plasma. The relatively long treatment periods necessary for the process according to the invention result from the fact that the diffusion speed of C and N is a function of the temperature and drops significantly for temperatures below 450° C. Long diffusion times of 12 to 60 hours are necessary at the required low temperatures to avoid the forming of chromium carbide and chromium nitride. Austenitic rust-resistant steels or so-called duplex steels (ferritic—austenitic steels) are highly insensitive to such long treatment periods and for all practical purposes do not change their other mechanical characteristics or the structure.

The molten salt bath is composed of a mixture of potassium chloride, barium chloride and lithium chloride salts. Alternatively, a molten salt bath of strontium chloride, potassium chloride and lithium chloride can also be used. Magnesium chloride and/or calcium chloride, for example in amounts of 0.1 to 10% by weight, can furthermore be used as an alternative to barium chloride or strontium chloride or in addition thereto. The melting points for the eutectic mixture of these salts are in the range of 320° C. to 350° C. Yellow potassium hexacyanoferrate (II), meaning $K_4Fe(CN)_6$ is added to these salts as the carbon-donating substance in amounts ranging from 0.2 to 25% by weight, in particular ranging from 1 to 25% by weight. The salt, which contains 3 mol equivalents of water of crystallization in the delivered form, should be dried at least 12-24 hours at 120-140° C. before it is added, so as to remove the water of crystallization. Alternatively, red potassium hexacyanoferrate (III) $K_3Fe(CN)_6$, which does not contain water of crystallization, can be added to the molten salt bath. The complex cyanide is preferably added in an amount ranging from 2 to 10% by weight.

Alternatively or in addition to the aforementioned complex iron cyanides, other complex metal cyanides can also be used as carbon-donating substances. Examples for this are tetracyanonickel or tetracyanozinc compounds such as $Na_2Ni(CN)_4$ or $Na_2Zn(CN)_4$.

Sodium cyanide and/or potassium cyanide in the free form can furthermore be added in place of the complex, non-toxic iron cyanides or metal cyanides, in amounts ranging from 0.1 to 25% by weight and preferably ranging from 3 to 10% by weight. The results are similar as for the use of complex cyanides, wherein mixtures of complex and free cyanides can also be used.

Using molten salt baths containing complex cyanides has the advantage that no toxic substances must be handled since hexacyanoferrate per se is not toxic. Free cyanides have the advantage of a low price, making this process advantageous if a waste water detoxification system exists for the cyanides.

The course of the process of diffusing carbon and nitrogen from the molten salt bath into the stainless steel and the function of the activator substances in this process is explained in the following with the example of a molten salt bath containing iron cyanides as carbon-donating substances. The operating temperature of the molten salt bath for this embodiment ranges from 350 to 420° C. At this temperature, the complex iron cyanides decompose as shown in the following:

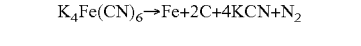

$$K_4Fe(CN)_6 \rightarrow Fe+2C+4KCN+N_2$$

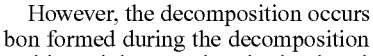

$$K_3Fe(CN)_6 \rightarrow Fe+3C+3KCN+3/2N_2$$

However, the decomposition occurs very slowly. The carbon formed during the decomposition diffuses into the austenitic stainless steel to be hardened and, at temperatures below 420° C., remains there in the form of a solid, saturated or over-saturated solution. Austenite has a high capacity for dissolving carbon and a lower capacity for dissolving nitrogen.

A portion of the nitrogen that forms is also diffused into the stainless steel surface. If the treatment temperature is below 350-370° C., then the nitrogen, in the same way as the carbon, remains in a solid solution. If the temperature is between 370 and 420° C., the nitrogen forms chromium nitride with the alloy element chromium and thus can potentially reduce the corrosion resistance of the stainless steel surface. Nevertheless, the forming of chromium carbide is still avoided in this temperature range, so that little chromium is extracted from the alloy matrix of the stainless steel despite the forming of chromium nitride at this temperature range. The reduction in the corrosion resistance of the stainless steel can therefore still be acceptable. To further improve the corrosion resistance at this temperature range, the diffusing in of nitrogen should be avoided and only carbon in a solid solution should be diffused into the component surface, wherein temperatures of up to 440° C. can be used. With temperatures below 370° C., on the other hand, nitrogen and carbon can be diffused in jointly in the form of a solid solution, without causing chromium nitride or chromium carbide to form.

The following reactions are furthermore possible in the molten salt bath:

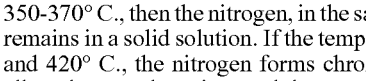

$$2KCN+O_2 \rightarrow 2KOCN$$

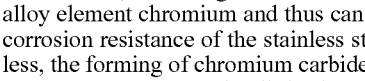

$$4KOCN \rightarrow K2CO_3+2KCN+CO+2<N>$$

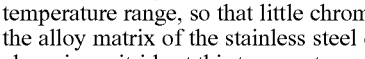

$$2KCN+2O_2 \rightarrow K_2CO_3+CO+N_2$$

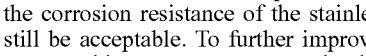

$$2CO+Fe \rightarrow Fe_3C+CO_2$$

Cyanide ions, which form during the decomposition of the complex metal salt, are oxidized by the atmospheric oxygen that is present throughout the molten salt bath and form cyanate ions, which can decompose and form carbon monoxide and nitrogen. Cyanate ions in most cases are the source for diffusion-capable nitrogen. Cyanide ions can oxidize further and form carbonate ions, wherein carbon monoxide is formed. Carbon monoxide can react further and form carbon dioxide by releasing diffusion-capable carbon.

In addition, cyanide can react with barium ions of the activator substance contained as barium chloride in the molten salt bath and can form barium cyanide $Ba(CN)_2$ which transforms to barium cyanamide BaNCN. In the process, carbon is released which can diffuse into the components.

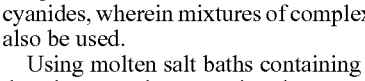

$$BaCl_2+2KCN \rightarrow Ba(CN)_2+2KCl$$

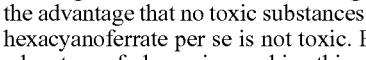

$$Ba(CN)_2 \rightarrow BaNCN+<C>$$

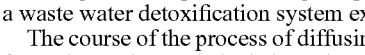

$$BaNCN+3/2O_2 \rightarrow BaCO_3+N_2$$

The barium cyanamide reacts further with the atmospheric oxygen to form barium carbonate and nitrogen, which is released. Similar reactions can be expected from strontium, calcium and magnesium, provided strontium chloride, calcium chloride and/or magnesium chloride is used as an activator substance. With the process according to the invention, the alkaline earth metals in the form of halogenides consequently form activator substances, which cause the release of nitrogen and carbon capable of diffusing in the temperature range specified for the process according to the invention. The diffusing of the required amount of carbon into the stainless steel surface is not possible without using at least one alkaline earth element from the family magnesium, calcium, strontium and barium. A similar role is played by the element lithium, which acts in a similar manner as the alkaline earth metals and also functions as an activator for the diffusion of carbon:

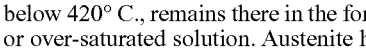

$$2LiCl+2KCN \rightarrow 2LiCN+2KCl$$

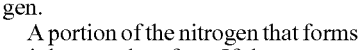

$$2LiCN \rightarrow Li_2NCN+<C>$$

$$Li_2NCN+3/2O_2 \rightarrow Li_2CO_3+N_2$$

The remaining alkaline metals Na, K, Rb and Cs do not have this effect.

The cited reactions explain the mechanism for transferring carbon and nitrogen to the treated components of stainless steel while these are submerged in eutectic molten salt baths composed of alkaline earth chlorides and lithium salts. They also explain the occurrence of small amounts of cyanate ions, for example in amounts of 0.1 to 10% by weight, and carbonate ions, for example in a concentration of 0.1 to 10% by weight, as a result of the oxidation processes after the molten salt bath has been in operation for a specific period.

An analytical control of the molten salt baths according to the invention can be realized as follows: The change in the concentration of active components (complex cyanides or free cyanide) can be monitored with the aid of potentiometric titration. In the case of $K_4Fe(CN)_6$, titration can occur with Cer(IV) sulfate solution. Free cyanide is easy to determine with nickel(II)sulfate. Used cyanide or complex cyanide is correspondingly replenished.

An inert gas such as argon, nitrogen, or carbon dioxide can be introduced into the molten salt bath according to the invention for the displacement of air and to prevent oxidation of the free and/or complex cyanide. It is particularly advantageous for displacing air and preventing oxidation of the free and complex cyanide if the molten salt bath is operated in a closed retort and using nitrogen, argon or carbon dioxide as protective gas.

BRIEF DESCRIPTION OF THE DRAWINGS

These and other features and advantages of the invention will be further understood from the following detailed description of the preferred embodiments with reference to the accompanying drawings, showing in.

DETAILED DESCRIPTION

Example 1

Inside a crucible of heat-resistant steel, for example 1.4828 steel, 42 kg dry potassium chloride, 34 kg dry lithium chloride and 20 kg barium chloride siccum are weighed in and loosely mixed together. All salts must have a residual moisture content of less than 0.3% by weight. The mixture is heated to 400° C. and results in a water-clear melt to which is slowly added the amount of 4 kg potassium hexacyanoferrate (II) that was previously dried for 12 hours at 140° C. inside a muffle furnace. When feeding in the potassium hexacyanoferrate (II), a very small amount of carbon is precipitated out along the crucible wall and on the surface of the molten salt bath. This carbon is skimmed off with a slotted spoon, leaving a water-clear melt which is then heated to an operating temperature of 400° C. Work pieces of stainless steel 1.4571 (material X6CrNiMoTil7-12.2), which weigh 10 kg and are attached to steel wires, are then submerged in and subjected to the effect of the molten salt bath for a period of 48 hours.

Figure 1:
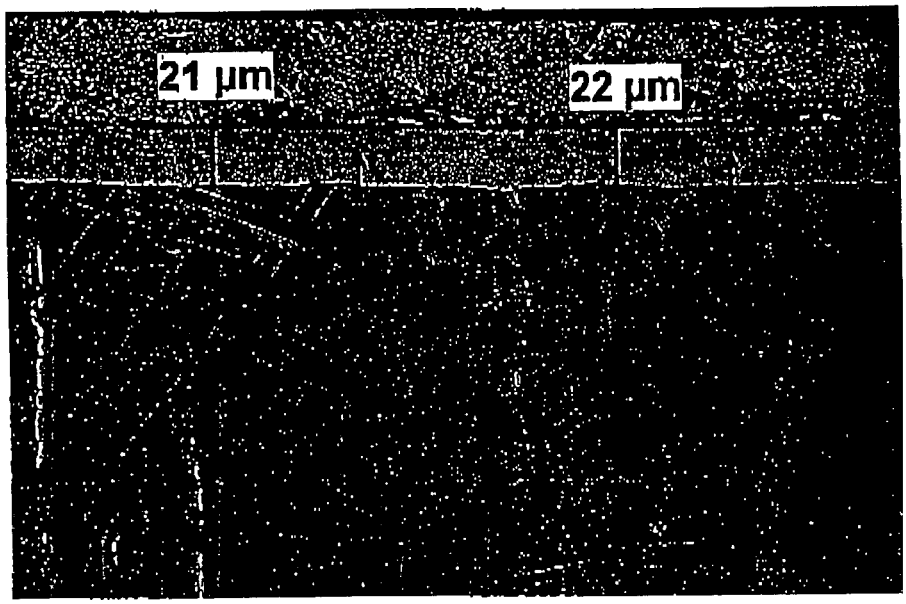
FIG. 1 is a representation of a cross section through a stainless steel 1.4571 sample, which is hardened in a molten salt bath according to the invention.
Figure 2:
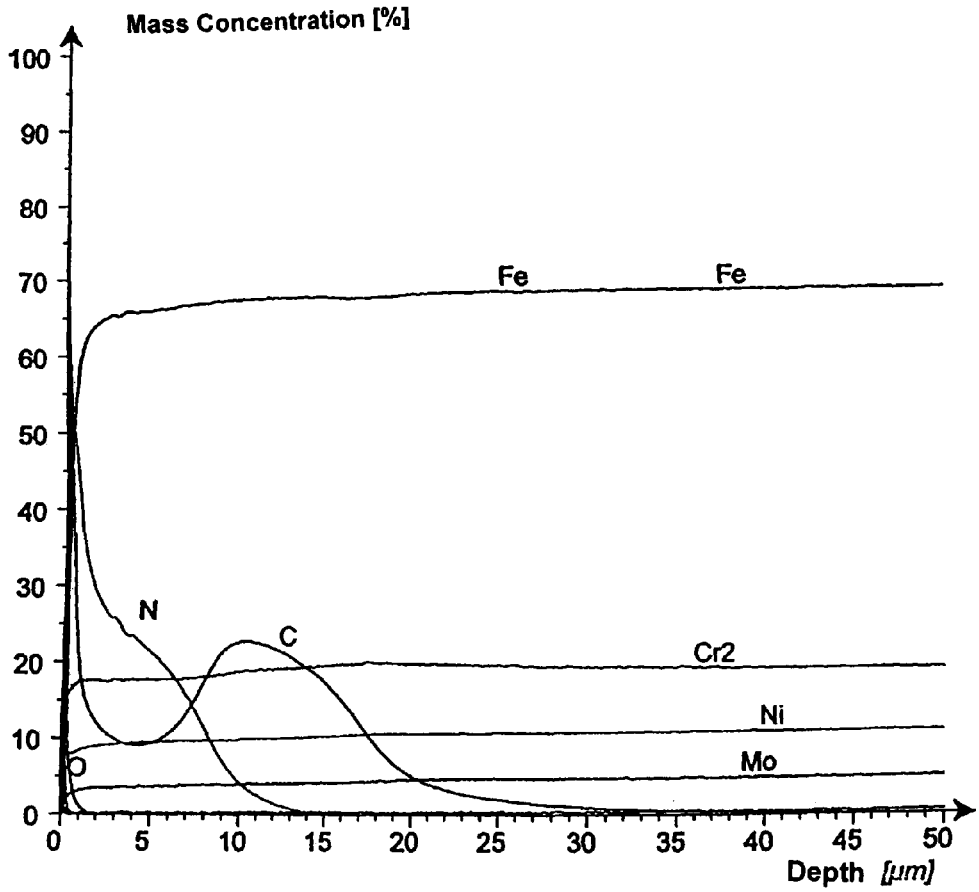
FIG. 2 is an element depth profile analysis of a stainless steel 1.4541 that is hardened in a molten salt bath according to the invention.

This treatment results in a 20-22 μm thick diffusion layer on the surface of the treated components and samples, which can be shown with the aid of a metallographic polish of cross section and by etching it with the reagent V2A etching agent. The V2A etching agent consists of a mixture of 100 ml water and 100 ml hydrochloric acid concentrate (HCl, 30%) and 0.3% "Vogels Reagenz" [Vogel reagent]. The Vogel reagent consists of a mixture of 60% 2-methoxy-2-propanol (H3C-O-CH2Oh-CH3), 5% thiourea (H2N-CS-NH2), 5% nonylphenol-ethoxylate residual ethanol. The cross section is shown with the photograph in FIG. 1, enlarged by the power of 500. The surface hardness of this layer is determined to be 642-715 HV (0.5) and/or 1100-1210 HV (0.025). The element distribution within the layer can be determined with the glow discharge spectroscopy (GDOES) and is shown with the example in FIG. 2. FIG. 2 shows the penetration depth for the elements N, C, Fe, $Cr_2$, Ni, Mo in the surface of the work piece that is hardened in the molten salt bath, meaning the mass concentrations of these elements in percentages are plotted in μm, in dependence on the penetration depth in the work piece. The curve courses for Fe, O, $Cr_2$ and Ni, shown in FIG. 2, respectively, relate to mass concentrations of 100% while the curve courses for C, Mo relate to mass concentrations of 10% and the curve course of N relates to a mass concentration of 25%. FIG. 2 shows that carbon is diffused to a depth of approximately 25-27 μm while nitrogen is diffused somewhat less deep. The carbon and nitrogen amounts detected in the surface layer of the work piece are not present in the form of nitrides or carbides, but for the most part are present in the form of nitrogen and carbon in a solid, oversaturated solution.

Figure 3:
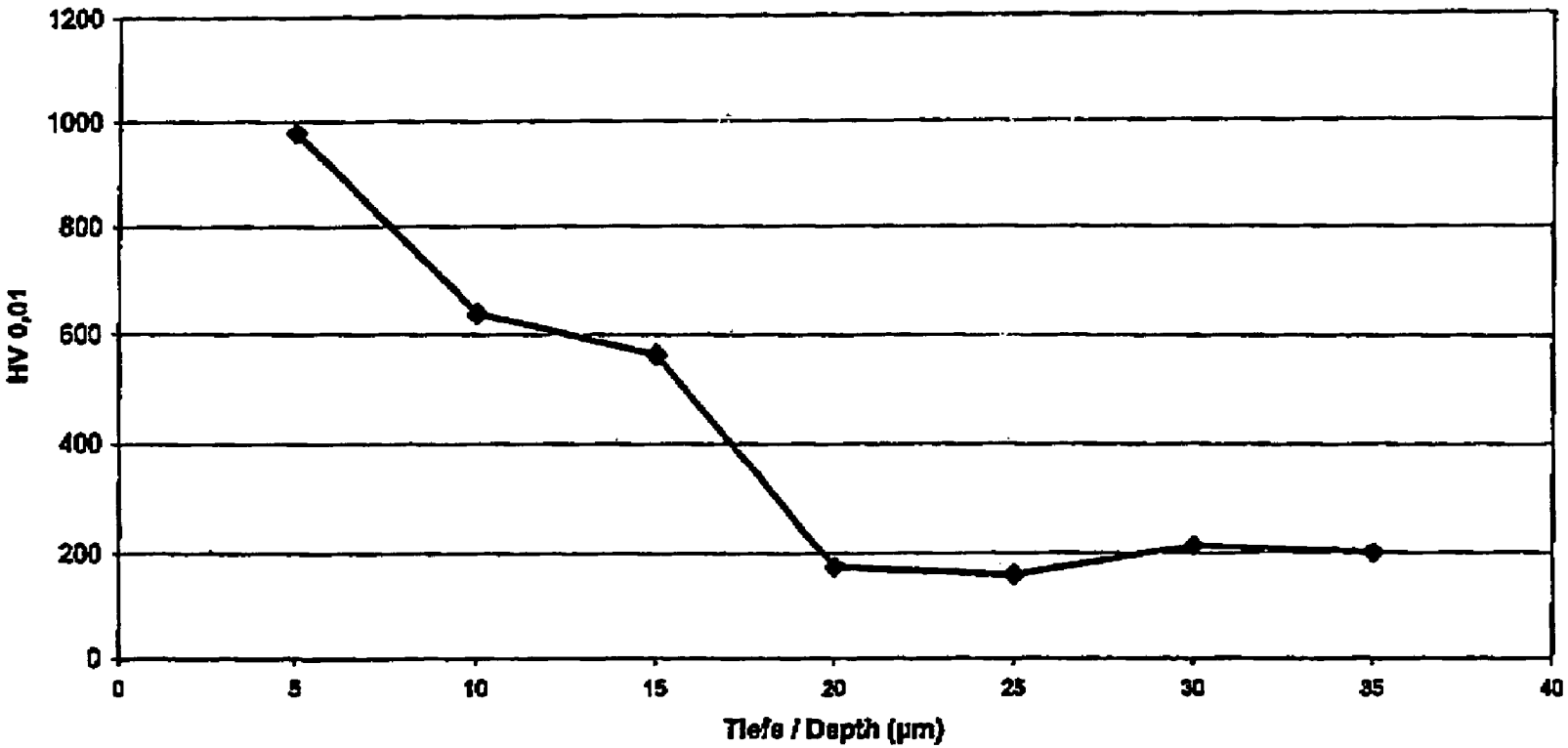
FIG. 3 illustrates the hardening progress in dependence on the penetration depth in the surface area of a stainless steel 1.4541 sample treated in the molten salt bath according to the invention.

FIG. 3 shows the progression of the hardening for this work piece in dependence on the depth (in μm), which is measured with the Vickers method under a test load of 0.010 kp (10 gram). A comparison of FIGS. 2 and 3 shows a significant improvement of the hardness of the work piece surface layer, into which nitrogen and carbon are diffused with the aid of the molten salt bath.

Example 2

The amounts of 43 kg dry potassium chloride, 30 kg dry lithium chloride, 17 kg strontium chloride siccum, and 3 kg barium chloride siccum are weighed into a crucible of heat-resistant steel and are loosely mixed. All salts must have a residual moisture content of less than 0.3% by weight. The mixture is heated to 400° C. and results in a water-clear melt to which is slowly added the amount of 7 kg potassium hexacyanoferrate (II) that is previously dried for 12 hours at 140° C. inside a muffle furnace. The operating temperature for the resulting water-clear melt is then lowered to 370° C. Work pieces of stainless steel 1.4301 that weigh 10 kg and are attached to steel wires are submerged into and are subjected to the influence of this molten salt bath for a period of 24-48 hours.

Depending on the length of time, the treatment results in a 10-25 μm thick diffusion layer on the surface of the treated components and samples. This can be shown with a metallographic cross section and by etching it with the V2A etching agent.

Example 3

The amounts of 37 kg dry potassium chloride, 26 kg dry lithium chloride, and 17 kg strontium chloride siccum are weighed into a crucible of heat-resistant steel and are loosely mixed together. All salts must have a residual moisture content of less than 0.3% by weight. The mixture is heated to 400° C. and results in a water-clear melt to which are slowly added the amounts of 10 kg KCN and 10 kg NaCN. The resulting melt is heated to an operating temperature of 400-410° C. Work pieces of stainless steel 1.4301, weighing 10 kg and attached to steel wires, are submerged into and subjected to the influence of this molten salt bath for a period of 24 hours.

The treatment results in a diffusion layer with a thickness of approximately 10 μm on the surface of the treated components and samples, which can be shown with a metallographic cross section and etching with the V2A etching agent. The hardness of this layer is determined to be 620 HV (0.5).

Example 4

The amounts of 42 kg dry potassium chloride, 34 kg dry lithium chloride, 10 kg barium chloride siccum and 10 kg strontium chloride siccum are weighed into a crucible of heat-resistant steel and are loosely mixed together. All salts must have a residual moisture content of less than 0.3% by weight. The mixture is heated to 400° C. and results in a water-clear melt to which is slowly added the amount of 4 kg $K_3Fe(CN)_6$. A water-clear melt forms, which is heated to an operating temperature of 400-410° C. Work pieces of stainless steel 1.4301 and 14541, weighing 10 kg and attached to steel wires, are submerged into and subjected to the influence of this molten salt bath for a period of 24 hours.

Example 5

The amounts of 42 kg dry potassium chloride, 34 kg dry lithium chloride, 10 kg barium chloride siccum and 2 kg strontium chloride siccum are weighed into a crucible of heat-resistant steel and are loosely mixed together. All salts must have a residual moisture content of less than 0.3% by weight. The mixture is heated to 400° C. and results in a water-clear melt to which are slowly added the amounts of 4 kg $K_3Fe(CN)_6$ as well as 4 kg KCN and 4 kg NaCN. A clear melt forms, which is then heated to an operating temperature of 400-410° C. Work pieces of stainless steel 1.4301 and 1.4541 that weigh 10 kg each and are attached to steel wires are submerged into and subjected to the influence of this molten salt bath for a period of 24 hours.

Example 6

A stainless steel work piece is submerged into a molten salt bath for a period ranging from 15 minutes to 240 hours and at temperatures below 450° C. The molten salt bath comprises, by weight, the following components: about 40% KCl, about 33% LiCl, about 2% $BaCl_2$, about 20% $SrCl_2$, and about 5% potassium hexacyanoferrate (II).

Example 7

A stainless steel work piece is submerged into a molten salt bath for a period ranging from 15 minutes to 240 hours and at temperatures below 450° C. The molten salt bath comprises, by weight, the following components: about 44% KCl, about 30% LiCl, about 5% $BaCl_2$, about 15% $SrCl_2$, about 3% potassium hexacyanoferrate (II), about 2% NaCN, and about 1% KCN.

It will be understood that the above description of the present invention is susceptible to various modifications, changes and adaptations, and that the same are intended to be comprehended within the meaning and range of equivalents of the appended claims.

What is claimed is:

1. A process for hardening a stainless steel work piece by diffusing carbon and/or nitrogen into surfaces of the work piece, comprising:

submerging the work piece into a molten salt bath for a period ranging from 15 minutes to 240 hours and at temperatures below 450° C., wherein the molten salt bath comprises, by weight, the following components:

30-60% potassium chloride (KCl), 20-40% lithium chloride (LiCl), 15-30% an activator substance selected from the group consisting of barium chloride ($BaCl_2$), strontium chloride ($SrCl_2$), magnesium chloride ($MgCl_2$), calcium chloride ($CaCl_2$) and admixtures thereof, and 0.2-25% a carbon-donating substance selected from the group consisting of a free cyanide, a complex cyanide and admixtures thereof.

2. The process according to claim 1, wherein the molten salt bath has a temperature in a range of 350° C. to 410° C.

3. The process according to claim 1, wherein the work piece is subjected for a period of 48 hours to the molten salt bath, and wherein the molten salt bath comprises, by weight, the following components:

about 42% KCl, about 34% LiCl, about 20% $BaCl_2$, and about 4% potassium hexacyanoferrate (II).

4. The process according to claim 1, further comprising:

conducting an inert gas through the molten salt bath to displace air and to prevent oxidation of free and complex cyanide.

5. The process according to claim 4, wherein the inert gas includes argon, nitrogen or carbon dioxide.

6. The process according to claim 5, further comprising operating the molten salt bath in a closed retort.

7. The process according to claim 1, wherein the activator substance comprises an admixture comprising:

$MgCl_2$ and/or $CaCl_2$ in amounts of 0.1 to 10% by weight of the molten salt bath; and $BaCl_2$and/or $SrCl_2$.

8. The process according to claim 1, wherein the carbon-donating substance comprises potassium hexacyanoferrate (II) and/or potassium hexacyanoferrate (III).

9. The process according to claim 8, wherein the components, by weight, comprise:

about 42% KCl, about 34% LiCl, about 20% $BaCl_2$ as the activator substance, and about 4% potassium hexacyanoferrate (II) as the carbon-donating substance.

10. The process according to claim 8, wherein the components, by weight, comprise:

about 40% KCl, about 33% LiCl, about 2% $BaCl_2$ and about 20% $SrCl_2$ as the activator substances, and about 5% potassium hexacyanoferrate (II) as the carbon-donating substance.

11. The process according to claim 1, wherein the carbon-donating substance comprises a tetracyanonickel compound or a tetracyanozinc compound.

12. The process according to claim 11, wherein the carbon-donating substance comprises $Na_2Ni(CN)_4$ or $Na_2Zn(CN)_4$.

13. The process according claim 1, wherein the carbon-donating substance comprises free cyanide of the alkaline metals selected from the group consisting of Li, Na, K and admixtures thereof, in amounts of 0.1 to 25% by weight of the molten salt bath.

14. The process according to claim 13, wherein the components, by weight, comprise:

about 44% KCl about 30% LiCl about 5% $BaCl_2$ and about 15% $SrCl_2$ as the activator substances, and about 3% potassium hexacyanoferrate (II), about 2% NaCN and about 1% KCN as the carbon-donating substance.

15. The process according to claim 13, wherein the components, by weight, comprise:

about 37% KCl, about 26% LiCl, about 17% $SrCl_2$ as the activator substance, and about 10% NaCN and about 10% KCN as the carbon-donating substance.

16. The process according to claim 1, wherein the molten salt bath further comprises:

cyanate ions (NCO) in amounts of 0.1 to 10% by weight and carbonate ions $(CO_3)^{2-}$ in a concentration of 0.1 to 10% by weight.

* * * * *